US008890762B2

(12) United States Patent
Wong et al.

(10) Patent No.: US 8,890,762 B2
(45) Date of Patent: Nov. 18, 2014

(54) COMMUNICATION ELECTRONIC DEVICE AND ANTENNA STRUCTURE THEREOF

(75) Inventors: Kin-Lu Wong, New Taipei (TW); Yeh-Chun Kao, New Taipei (TW)

(73) Assignee: Acer Incorporated, Xizhi Dist., New Taipei (TW)

( * ) Notice: Subject to any disclaimer, the term of this patent is extended or adjusted under 35 U.S.C. 154(b) by 138 days.

(21) Appl. No.: 13/316,547

(22) Filed: Dec. 11, 2011

(65) Prior Publication Data

US 2013/0076587 A1 Mar. 28, 2013

(30) Foreign Application Priority Data

Sep. 27, 2011 (TW) ..... 100134786 A

(51) Int. Cl.
*H01Q 1/48* (2006.01)
*H01Q 1/24* (2006.01)

(52) U.S. Cl.
CPC . *H01Q 1/48* (2013.01); *H01Q 1/243* (2013.01)
USPC ..... 343/848

(58) Field of Classification Search
USPC ..... 343/848
See application file for complete search history.

(56) References Cited

U.S. PATENT DOCUMENTS

| | | | | |
|---|---|---|---|---|
| 7,385,561 | B2 * | 6/2008 | Krupa | 343/728 |
| 7,450,072 | B2 | 11/2008 | Kim | |
| 2004/0058723 | A1 | 3/2004 | Mikkola | |
| 2006/0109175 | A1 | 5/2006 | Yeh | |
| 2008/0180333 | A1 * | 7/2008 | Martiskainen et al. | 343/722 |
| 2010/0225544 | A1 * | 9/2010 | Taura | 343/702 |
| 2010/0328182 | A1 * | 12/2010 | Wong et al. | 343/848 |

FOREIGN PATENT DOCUMENTS

| | | | |
|---|---|---|---|
| CN | 101997165 | A | 3/2011 |
| EP | 1 401 050 | A1 | 3/2004 |
| EP | 1 562 259 | A1 | 8/2005 |
| JP | 200022435 | A | 1/2000 |
| KR | 101204508 | B1 | 11/2012 |
| WO | 04001894 | A1 | 12/2003 |

* cited by examiner

*Primary Examiner* — Dameon E Levi
*Assistant Examiner* — Andrea Lindgren Baltzell
(74) *Attorney, Agent, or Firm* — Winston Hsu; Scott Margo

(57) ABSTRACT

A communication electronic device includes a grounding element and an antenna element. There is a first notch, a second notch and a first protruded portion disposed at an edge of the grounding element, and the first notch and the second notch are not located at corners of the edge of the grounding element. The first protruded portion is located between the first notch and the second notch. The antenna element and the grounding element are disposed on different planes. The antenna element has a projection on the grounding element, and the projection covers a portion of the first protruded portion, a portion of the first notch and a portion of the second notch.

18 Claims, 5 Drawing Sheets

COMMUNICATION ELECTRONIC DEVICE AND ANTENNA STRUCTURE THEREOF

BACKGROUND OF THE INVENTION

1. Field of the Invention

The present invention relates to a communication electronic device and an antenna structure disposed thereon, and more particularly, to a communication electronic device and an antenna structure with a grounding element having a plurality of notches and a protruded portion disposed at an edge, wherein a built-in multiband antenna element is located at the edge, such that the antenna element is capable of achieving a wideband operation and can be closely integrated with the grounding element.

2. Description of the Prior Art

With the progress of mobile communication technology, mobile communication devices have made a large impact on human lives, and our living environment is rife with electromagnetic waves of various operating systems. As a result, effects of electromagnetic waves on the human body have become a significant topic, especially regarding communication electronic devices that require longtime contact with users, such as mobile phones and tablet computers. Additionally, the performance of the built-in antenna of the communication electronic device may be affected by influences resulting from a user's hand when the communication electronic device is in use, and this issue is also an important topic in the field. For example, in the conventional art, such as U.S. Pat. No. 7,768,466 entitled "Multiband folded loop antenna", a communication electronic device with a multiband loop antenna is disclosed, wherein the loop antenna is disposed at an edge of the grounding element and occupies the overall edge in order to achieve a wideband operation. Such an antenna configuration cannot be closely combined with peripheral electronic elements, which results in a waste of interior space of the device. Also, since the distance between the user's hand and the antenna element is small when the communication electronic device is in use, the radiation performances of the antenna may be easily affected by the user's hand.

Hence, how to provide a communication electronic device having an antenna with two wide operating bands at least covering from 824 MHz to 960 MHz and from 1710 MHz to 2170 MHz to satisfy the five-band WWAN operation has become an important topic in this field. In addition, it is desired that the distance between the antenna and the user's hand can be increased in order to reduce influences resulting from the user's hand, and enabling the antenna element to be closely integrated with peripheral electronic elements.

SUMMARY OF THE INVENTION

It is therefore one of the objectives of the present invention to provide a communication electronic device and an antenna structure for reducing influences resulting from a user's hand when the communication electronic device is in use, and enabling the antenna element to be closely integrated with peripheral electronic elements (such as data transfer ports).

According to an aspect of the present invention, a communication electronic device comprising an antenna structure is provided. The antenna structure may include a grounding element and an antenna element. There is a first notch, a second notch and a first protruded portion disposed at an edge of the grounding element, wherein the first notch and the second notch are not located at corners of the edge of the grounding element, and the first protruded portion is located between the first notch and the second notch. A first length of the first notch located at the edge of the grounding element is between 20% and 40% of a length of the edge; and a second length of the second notch located at the edge of the grounding element is between 20% and 40% of the length of the edge. In addition, the antenna element and the grounding element are disposed on different planes. The antenna element has a projection on the grounding element, and the projection covers a portion of the first protruded portion, a portion of the first notch, and a portion of the second notch.

According to another aspect of the present invention, an antenna structure is provided. The antenna structure may include a grounding element and an antenna element. There is a first notch, a second notch and a first protruded portion disposed at an edge of the grounding element, wherein the first notch and the second notch are not located at corners of the edge of the grounding element, and the first protruded portion is located between the first notch and the second notch. In addition, the antenna element and the grounding element are disposed on different planes. The antenna element has a projection on the grounding element, and the projection covers a portion of the first protruded portion, a portion of the first notch, and a portion of the second notch.

In order to overcome the influences resulting from the peripheral grounding element, the antenna element of the present invention adopts a loop antenna having a closed loop, and having a first operating band and a second operating band. The loop antenna can be coupled to the grounding element through the shorting end in order to excite a resonant mode for forming a first operating band, wherein the resonant length is equal to a half-wavelength of a center frequency of the first operating band. Additionally, a full-wavelength resonant mode can be excited by the loop antenna so as to form the second operating band. The first operating band covers about 824 MHz to 960 MHz, and the second operating band covers about 1710 MHz to 2170 MHz.

These and other objectives of the present invention will no doubt become obvious to those of ordinary skill in the art after reading the following detailed description of the preferred embodiment that is illustrated in the various figures and drawings.

DETAILED DESCRIPTION

The following description is of the best-contemplated mode of carrying out the present invention. A detailed description is given in the following embodiments with reference to the accompanying drawings.

Certain terms are used throughout the description and following claims to refer to particular components. As one skilled in the art will appreciate, manufacturers may refer to a component by different names. This document does not intend to distinguish between components that differ in name but not function. In the following description and in the claims, the terms "include" and "comprise" are used in an open-ended fashion, and thus should be interpreted to mean "include, but not limited to . . . ". Also, the term "couple" is intended to mean either an indirect or direct electrical connection. Accordingly, if one device is coupled to another device, that connection may be through a direct electrical connection, or through an indirect electrical connection via other devices and connections.

Figure 1:
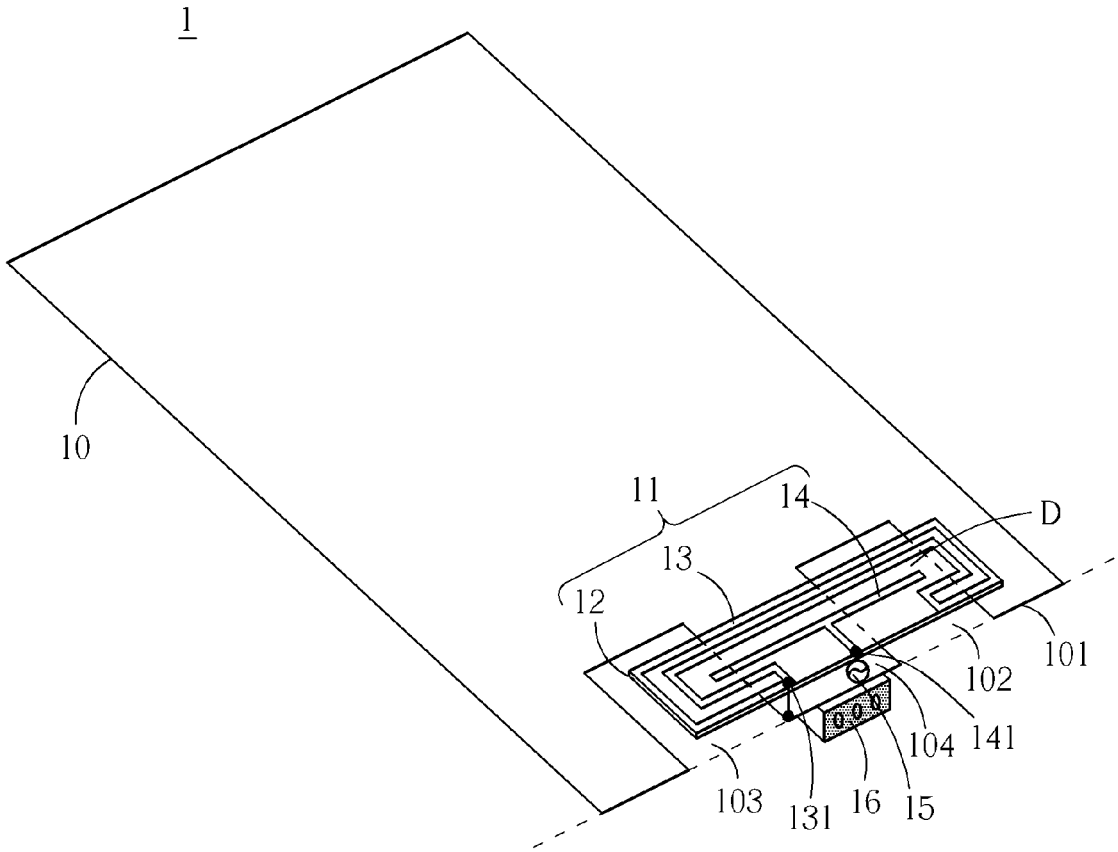
FIG. 1 is a diagram illustrating a communication electronic device and an antenna structure disposed therein according to a first embodiment of the present invention.
Figure 2:
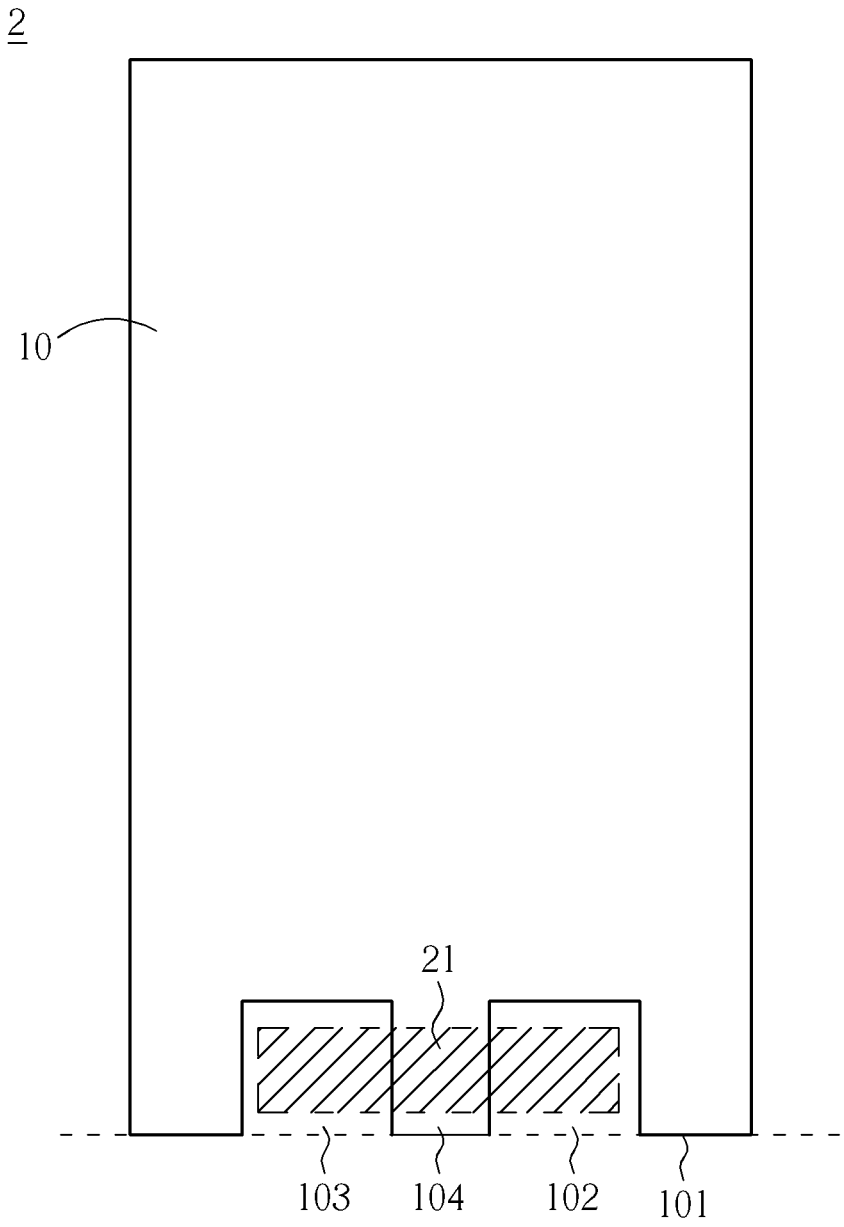
FIG. 2 is a diagram illustrating the grounding element of the communication electronic device and the antenna structure disposed therein according to the first embodiment of the present invention.

Please refer to FIG. 1 together with FIG. 2. FIG. 1 is a diagram illustrating a communication electronic device 1 and an antenna structure disposed therein according to a first embodiment of the present invention, and FIG. 2 is a diagram illustrating the grounding element of the communication electronic device 1 according to a first embodiment of the present invention. In this embodiment, the communication electronic device 1 may include a grounding element 10 and an antenna element 11. There is a first notch 102, a second notch 103, and a first protruded portion 104 disposed at an edge 101 of the grounding element 10. What calls for special attention is that: the first notch 102 and the second notch 103 are not located at corners of the edge 101 of the grounding element 10; and the first protruded portion 104 is located between the first notch 102 and the second notch 103. In other words, the grounding element 10 forms an inverted E shape. In this embodiment, the antenna element 11 and the grounding element 10 are disposed on different planes, and thus the antenna element 11 has a projection 21 on the grounding element 10 (as is shown in FIG. 2), wherein the projection 21 covers a portion of the first protruded portion 104, a portion of the first notch 102, and a portion of the second notch 103. In addition, the first protruded portion 104 is used for accommodating an electronic element 16.

In this embodiment, the antenna element 11 may include a substrate 12, a shorted loop strip 13, and a feeding portion 14, but this in no way should be considered as a limitation of the present invention. Herein the shorted loop strip 13 forms a closed loop and has a shorting end 131, and the shorted loop strip 13 is electronically connected to the grounding element 10 through the shorting end 131. Moreover, the feeding portion 14 may include a feeding end 141 electronically connected to a signal source 15, wherein the feeding portion 14 is arranged for exciting the shorted loop strip 13.

What calls for special attention is that: in this embodiment, the shorted loop strip 13 at least partially surrounds the feeding portion 14. A coupling gap D exists between the shorted loop strip 13 and the feeding portion 14, and the coupling gap D is about 0.5 mm. The feeding portion 14 shown in the first embodiment forms a T shape.

Figure 3:
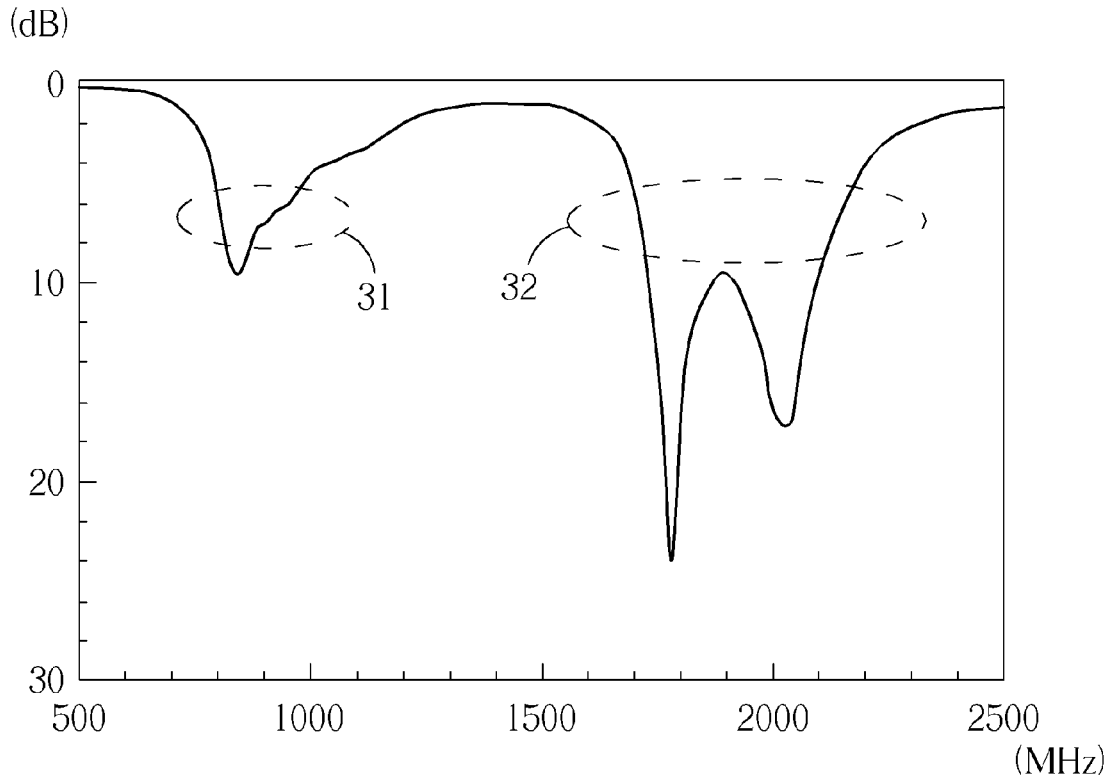
FIG. 3 is a diagram illustrating the return loss of the communication electronic device and the antenna structure disposed therein according to the first embodiment of the present invention.

Please refer to FIG. 1 together with FIG. 3. FIG. 3 is a diagram illustrating the return loss of the communication electronic device 1 and the antenna structure disposed therein according to a first embodiment of the present invention. In this embodiment, the size of the communication electronic device 1 is as follows: the grounding element 10 has a length of 115 mm and a width of 60 mm; the first notch 102 has a width of 20 mm and a depth of 10 mm; the second notch 103 has a width of 20 mm and a depth of 10 mm, wherein both the first notch 102 and the second notch 103 are not located at corners of the edge 101 of the grounding element 10; the first protruded portion 104 has a width of 10 mm and a length of 10 mm; the shorted loop strip 13 has a length of 150 mm; and the projection 21 of the antenna element 11 on the grounding element 10 has a size of 10×42 $mm^2$. According to the experimental results and a 6-dB return-loss definition, the first operating band 31 of the communication electronic device 1 and its antenna structure may cover the two-band GSM850/900 operation (from about 824 MHz to 960 MHz), and the second operating band 32 may cover the three-band GSM1800/1900/UMTS operation (from about 1710 MHz to 2170 MHz), thereby the antenna structure can satisfy requirements of the five-band WWAN operation. Additionally, in this embodiment, the shorted loop strip 13 is excited through the feeding portion 14, such that a half-wavelength resonant mode is excited at the lower frequencies (around 860 MHz) in order to form a wide first operating band 31 at least covering 824 MHz to 960 MHz, and a higher-order resonant mode is excited at the higher frequencies (such as 1800 MHz). In addition, a higher-frequency resonant mode can be excited by the feeding portion 14 at around 2000 MHz, and these two higher-frequency resonant modes are combined to form a wide second operating band 32 at least covering 1710 MHz to 2170 MHz. What calls for special attention is that: the shorted loop strip 13 forms a closed metal loop having a balanced characteristic for reducing the coupling effect between the antenna element 11 and the grounding element 10 or surroundings, such that the antenna element 11 can be closely combined with the adjacent grounding element 10 and has a lower near-field radiation. Since the antenna element 11 is surrounded by the first notch 102 and the second notch 103 of the grounding element 10, the coupling effect resulting from the user's hand and the antenna element 11 can be reduced when the communication electronic device 1 is in use. Moreover, the first protruded portion 104 can be further used for accommodating an electronic element 16 (such as a data transfer port), such that the antenna structure can be closely integrated with peripheral electronic elements, has a simple structure and can be manufactured easily, which can satisfy requirements of practical applications.

Figure 4:
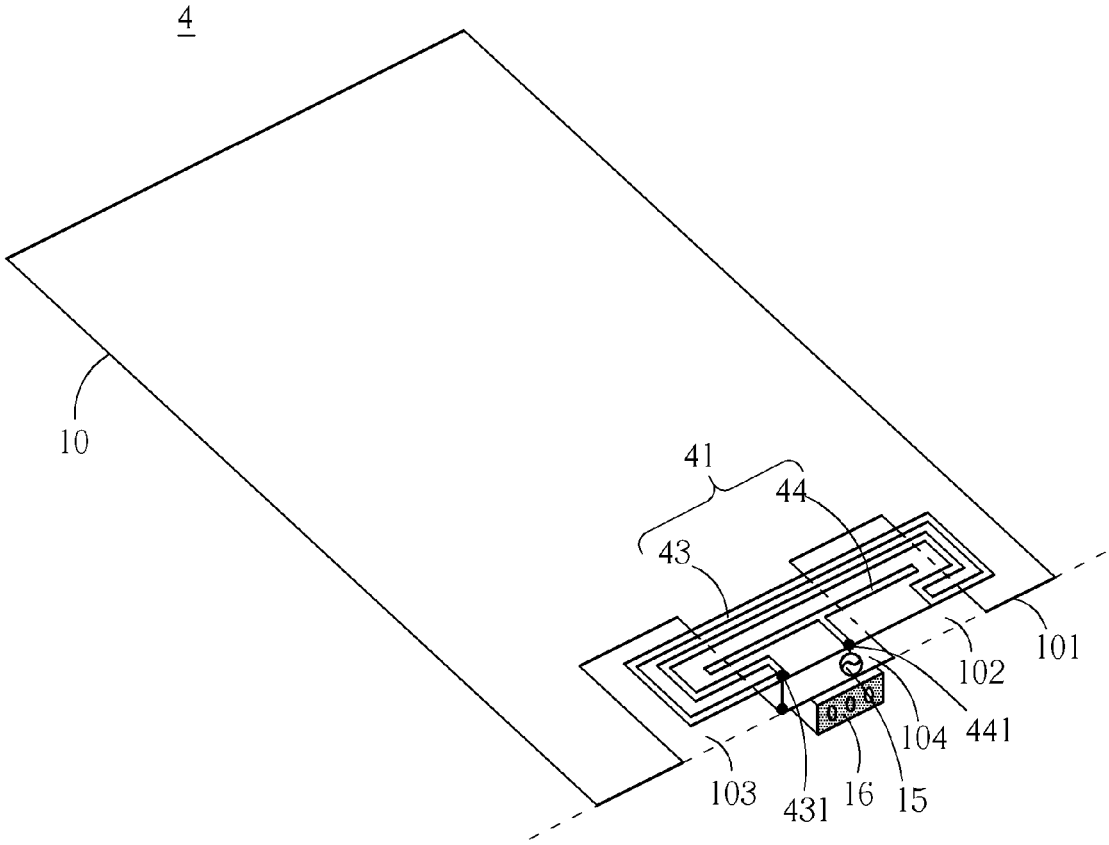
FIG. 4 is a diagram illustrating a communication electronic device and an antenna structure disposed therein according to a second embodiment of the present invention.

Please refer to FIG. 4, which is a diagram illustrating a communication electronic device 4 and an antenna structure disposed therein according to a second embodiment of the present invention. The structure of the communication electronic device 4 shown in the second embodiment is similar to that of the communication electronic device 1 shown in the first embodiment, and the difference between them is that: an antenna element 41 (including a shorted loop strip 43 and a feeding portion 44) of the communication electronic device 4 shown in FIG. 4 is not disposed on the substrate. In other words, the antenna element 41 can be manufactured by cutting a metal sheet directly so as to increase its manufacture flexibility.

Figure 5:
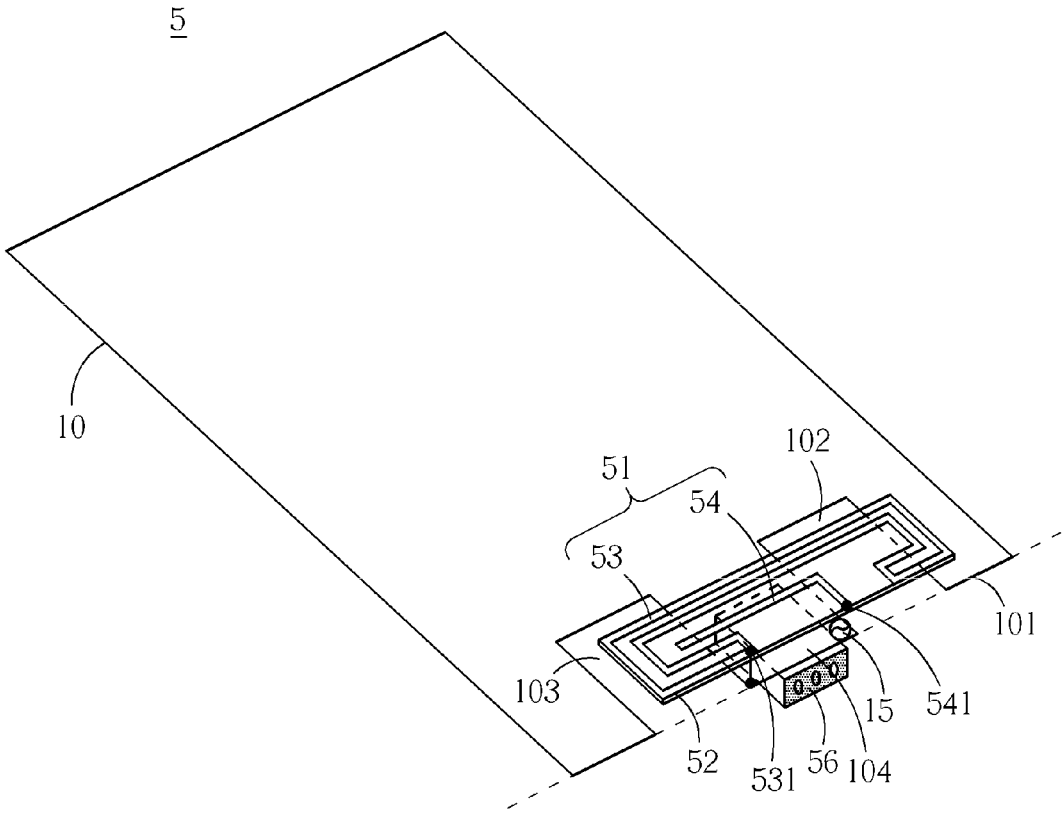
FIG. 5 is a diagram illustrating a communication electronic device and an antenna structure disposed therein according to a third embodiment of the present invention.

Please refer to FIG. 5, which is a diagram illustrating a communication electronic device 5 and an antenna structure disposed therein according to a third embodiment of the present invention. The structure of the communication electronic device 5 shown in the third embodiment is similar to that of the communication electronic device 1 shown in the first embodiment, and the difference between them is that: an electronic element 56 shown in FIG. 5 is located between the antenna element 51 (including a shorted loop strip 53 and a feeding portion 54) and the first protruded portion 104 so as to reduce the whole thickness of the communication electronic device 5. Furthermore, in this embodiment, the feeding portion 54 forms an L shape. In other words, the shape of the feeding portion 14/44/54 of the antenna element 11/41/51 is not limited.

It should be noted that either the structure of the communication electronic device 4 of the second embodiment or the structure of the communication electronic device 5 of the third embodiment is similar to that of the communication electronic device 1 of the first embodiment, and forms two similar wide operating bands to cover the five-band WWAN operation.

Those skilled in the art should appreciate that various modifications of the communication electronic devices and the antenna structures shown in FIG. 1, FIG. 4, and FIG. 5 may be made without departing from the spirit of the present invention. In addition, the shape and the number of the bends of the shorted loop strip 13/43/53 and the feeding portion 14/44/54 are not limited, and the bending direction, the bending angle, and the bending shape of the bends should not be considered as a limitation of the present invention.

In summary, a communication electronic device and its antenna structure are provided, which include an antenna element capable of forming two wide operating bands. Such an antenna structure has a simple structure and a lower near-field radiation, such that the coupling effect resulting from the user's hand can be reduced when the communication electronic device is in use, and the antenna element can be closely integrated with adjacent electronic elements. The two operating bands of the antenna structure may cover the two-band GSM850/900 operation (from about 824 MHz to 960 MHz) and the three-band GSM1800/1900/UMTS operation (from about 1710 MHz to 2170 MHz), respectively, thereby satisfying requirements of the five-band WWAN operation.

Those skilled in the art will readily observe that numerous modifications and alterations of the device and method may be made while retaining the teachings of the invention. Accordingly, the above disclosure should be construed as limited only by the metes and bounds of the appended claims.

What is claimed is:

1. A communication electronic device having an antenna structure, the antenna structure comprising:

a grounding element, wherein there is a first notch, a second notch and a first protruded portion disposed at an edge of the grounding element, the first notch and the second notch are not located at corners of the edge of the grounding element, and the first protruded portion is located between the first notch and the second notch; and an antenna element, wherein the antenna element and the grounding element are disposed on different planes, comprising:

a shorted loop strip, wherein the shorted loop strip forms a closed loop and has a shorting end, and the shorted loop strip is electronically connected to the grounding element through the shorting end; and a feeding portion, comprising a feeding end electronically connected to a signal source, wherein the feeding portion is arranged for exciting the shorted loop strip;

wherein the antenna element overlaps a portion of the first protruded portion, a portion of the first notch, and a portion of the second notch.

2. The communication electronic device according to claim 1, wherein the grounding element forms an inverted E shape.

3. The communication electronic device according to claim 1, wherein a first length of the first notch located at the edge of the grounding element is between 20% and 40% of a length of the edge; and a second length of the second notch located at the edge of the grounding element is between 20% and 40% of the length of the edge.

4. The communication electronic device according to claim 1, wherein the shorted loop strip at least partially surrounds the feeding portion.

5. The communication electronic device according to claim 1, wherein there is a coupling gap between the shorted loop strip and the feeding portion, and the coupling gap is about 0.5 mm.

6. The communication electronic device according to claim 1, wherein the feeding portion forms a T shape or an L shape.

7. The communication electronic device according to claim 1, wherein the antenna element comprises a first operating band and a second operating band, the first operating band covers about 824 MHz to 960 MHz, and the second operating band covers about 1710 MHz to 2170 MHz.

8. The communication electronic device according to claim 1, wherein the first protruded portion is used for accommodating an electronic element.

9. The communication electronic device according to claim 8, wherein the electronic element is located between the antenna element and the first protruded portion.

10. An antenna structure, comprising:

a grounding element, wherein there is a first notch, a second notch and a first protruded portion disposed at an edge of the grounding element, the first notch and the second notch are not located at corners of the edge of the grounding element, and the first protruded portion is located between the first notch and the second notch; and an antenna element, wherein the antenna element and the grounding element are disposed on different planes, comprising:

a shorted loop strip, wherein the shorted loop strip forms a closed loop and has a shorting end, and the shorted loop strip is electronically connected to the grounding element through the shorting end; and a feeding portion, comprising a feeding end electronically connected to a signal source, wherein the feeding portion is arranged for exciting the shorted loop strip;

wherein the antenna element overlaps a portion of the first protruded portion, a portion of the first notch, and a portion of the second notch.

11. The antenna structure according to claim 10, wherein the grounding element forms an inverted E shape.

12. The antenna structure according to claim 10, wherein a first length of the first notch located at the edge of the grounding element is between 20% and 40% of a length of the edge; and a second length of the second notch located at the edge of the grounding element is between 20% and 40% of the length of the edge.

13. The antenna structure according to claim 10, wherein the shorted loop strip at least partially surrounds the feeding portion.

14. The antenna structure according to claim 10, wherein there is a coupling gap between the shorted loop strip and the feeding portion, and the coupling gap is about 0.5 mm.

15. The antenna structure according to claim 10, wherein the feeding portion forms a T shape or an L shape.

16. The antenna structure according to claim 10, wherein the antenna element comprises a first operating band and a second operating band, the first operating band covers about 824 MHz to 960 MHz, and the second operating band covers about 1710 MHz to 2170 MHz.

17. The antenna structure according to claim 10, wherein the first protruded portion is used for accommodating an electronic element.

18. The antenna structure according to claim 17, wherein the electronic element is located between the antenna element and the first protruded portion.

* * * * *